US009394930B2

(12) United States Patent
Bedi et al.

(10) Patent No.: US 9,394,930 B2
(45) Date of Patent: Jul. 19, 2016

(54) METHOD AND DEVICE FOR COOLANT RECYCLING

(71) Applicant: K.J. Manufacturing Co., Wixom, MI (US)

(72) Inventors: Ram D. Bedi, Bloomfield Township, MI (US); George Blundy, Walled Lake, MI (US)

(73) Assignee: K.J. Manufacturing Co., Wixom, MI (US)

( * ) Notice: Subject to any disclaimer, the term of this patent is extended or adjusted under 35 U.S.C. 154(b) by 467 days.

(21) Appl. No.: 13/844,239

(22) Filed: Mar. 15, 2013

(65) Prior Publication Data

US 2014/0053907 A1 Feb. 27, 2014

Related U.S. Application Data

(63) Continuation-in-part of application No. 13/296,736, filed on Nov. 15, 2011, now Pat. No. 8,590,580.

(60) Provisional application No. 61/413,792, filed on Nov. 15, 2010.

(51) Int. Cl.
*F15D 1/00* (2006.01)
*F01P 11/02* (2006.01)

(52) U.S. Cl.
CPC ..... *F15D 1/00* (2013.01); *F01P 11/0204* (2013.01); *Y10T 137/0318* (2015.04); *Y10T 137/86083* (2015.04)

(58) Field of Classification Search
CPC .... F01P 11/02; F01P 11/0204; F01P 11/0276
USPC ..... 141/65, 67, 98, 198, 204, 216, 220; 137/15.26, 101.27, 120, 129
See application file for complete search history.

(56) References Cited

U.S. PATENT DOCUMENTS 3,280,858 A * 10/1966 Paulson ..... F04F 3/00 123/198 R
5,390,636 A * 2/1995 Baylor ..... F02B 77/04 123/198 A (Continued)

FOREIGN PATENT DOCUMENTS

JP 05163942 6/1993
JP 08109826 4/1996

(Continued)

OTHER PUBLICATIONS

International Search Report for PCT/US2011/060778 dated Jun. 1, 2012.
International Search Report for PCT/US2014/030433 dated Sep. 24, 2015.

*Primary Examiner* — Timothy L Maust
(74) *Attorney, Agent, or Firm* — Young Basile Hanlon & MacFarlane, P.C.; Denise M. Glassmeyer

(57) ABSTRACT

A method for replacing a volume of coolant fluid in a circulating system in diesel engine system that includes the steps of establishing pneumatic connection with at least one location in the diesel engine coolant fluid circulating system; establishing fluid connection with at least one point in the diesel engine coolant fluid circulating system, the fluid connection location being different from the pneumatic connection; and after pneumatic and fluid connection is established, drawing a vacuum pressure through said pneumatic connection and introducing the volume of coolant fluid through said fluid connection as well as a device for accomplishing the same.

10 Claims, 14 Drawing Sheets

(56) References Cited

U.S. PATENT DOCUMENTS

| | | | | |
|---|---|---|---|---|
| 6,193,895 | B1 | 2/2001 | Dea et al. | |
| 6,584,994 | B2 * | 7/2003 | Knowles | B67D 7/3209 137/14 |
| 6,595,248 | B1 * | 7/2003 | Rome | F01M 11/0458 141/65 |
| 6,637,468 | B1 * | 10/2003 | Wu | F01P 11/06 141/100 |

FOREIGN PATENT DOCUMENTS

| | | |
|---|---|---|
| KR | 100120411 | 8/1997 |
| RU | 2056005 | 3/1996 |
| RU | 2112902 | 6/1998 |
| WO | 2004/030804 | 4/2004 |

* cited by examiner

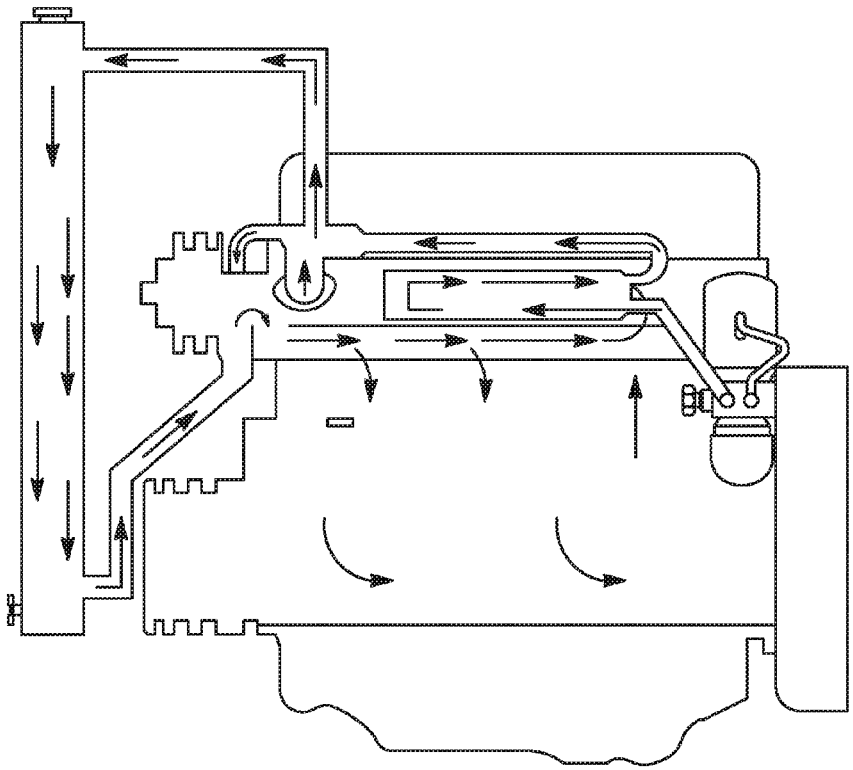

FIG. 12

REPRESENTATIVE COOLANT COOLANT DRAIN OPERATING INSTRUCTIONS

NOTE: IN ORDER TO PREVENT OVERFILLING OF COOLANT, MAKE SURE THAT THE RECYCLING TANK IS AT THE EMPTY LEVEL BEFORE STARTING THE PROCESS

A. CONNECT VACUUM / PRESSURE HOSE TO COOLANT SURGE TANK
B. CONNECT DRAIN / FILL HOSE TO ESOC CONNECTION ON BOTTOM OF RADIATOR
C. OPEN BALL VALVE ON DRAIN / FILL HOSE
D. FLIP "DRAIN" TOGGLE SWITCH TO "ON" POSITION
E. WHEN AIR ENTERS THE DRAIN / FILL HOSE, THE COOLANT SYSTEM IS EMPTY
F. FLIP "DRAIN" TOGGLE SWITCH TO "OFF" POSITION
G. CLOSE BALL VALVE
H. DISCONNECT HOSES

FIG. 13

REPRESENTATIVE FILL COOLANT OPERATING INSTRUCTIONS

A. CONNECT VACUUM / PRESSURE HOSE TO COOLANT SURGE TANK
B. CONNECT DRAIN / FILL HOSE TO ESOC CONNECTION ON BOTTOM OF RADIATOR
C. OPEN BALL VALVE ON DRAIN / FILL HOSE
D. FLIP "DRAIN" TOGGLE SWITCH TO "ON" POSITION
E. WHEN COOLANT ENTERS THE SURGE TANK, FLIP "FILL" TOGGLE SWITCH TO "OFF" POSITION

NOTE:

1 COOLANT WILL CONTINUE TO FLOW UNTIL THE RECYCLING TANK IS EMPTY AND THE SYSTEM WILL AUTOMATICALLY STOP
2 PLEASE BE AWARE THAT AT THIS POINT THE TANK IS STILL UNDER PRESSURE UNTIL RELIEVED BY DISCONNECTING THE AIR SUPPLY OR OPENING THE BALL VALVE UNDERNEATH THE FILL PAN

F. DISCONNECT HOSES, UNLESS THE COOLANT LEVEL NEEDS TO BE ADJUSTED
G. IF COOLANT LEVEL IS LOW AFTER FILL:

- OPEN BALL VALVE BELOW FILL TANK TO RELIEF PRESSURE
- ADD DESIRED AMOUNT OF COOLANT TO THE FILL PAN WITH THE BALL VALVE IN THE OPEN POSITION
- CLOSE THE BALL VALVE
- PERFORM FILL CYCLE AS DESCRIBED ABOVE

- OR -

- ADD COOLANT TO THE SURGE TANK TO THE DESIRED LEVEL

PRESSURE TEST COOLANT SYSTEM

A. CONNECT VACUUM / PRESSURE HOSE TO SURGE TANK
B. FLIP "DRAIN" TOGGLE SWITCH TO "ON" POSITION;PRESSURE WILL BUILD TO 15 PSIG
C. INSPECT FOR LEAKS
D. AFTER INSPECTION, TURN OFF ESOC AND DISCONNECT

INSTRUCTIONS FOR MINOR COOLANT SERVICE

THE SYSTEM CAN CREATE A VACUUM THAT WILL ALLOW REMOVING AND REPLACING CERTAIN SMALL COMPONENTS WITHOUT HAVING TO DRAIN THE RADIATOR. THE IS USEFUL WHEN INSTALLING THE ESOC DRAIN CONNECTION OR REPLACING A SENSOR

A. CONNECT VACUUM / PRESSURE HOSE TO SURGE TANK
B. FLIP "FILL" TOGGLE SWITCH TO "ON" POSITION
C. WHEN SERVICE IS COMPLETED TURN TOGGLE SWITCH "OFF" AND
D. DISCONNECT HOSES

FIG. 14

REMINDER:

MAKE SURE THAT THE RECYCLING TANK IS AT THE EMPTY LEVEL BEFORE STARTING THE NEXT PROCESS

METHOD AND DEVICE FOR COOLANT RECYCLING

The present application is a continuation in part application of U.S. Ser. No. 13/296,736 filed Nov. 15, 2011 currently pending, the disclosure of which is incorporated by reference herein in its entirety which claims priority the benefit of U.S. Ser. No. 61/413,792 filed Nov. 15, 2010, the disclosure of which is incorporated by reference herein in its entirety.

BACKGROUND

The present invention is directed to a method and device for coolant recycling. More particularly, the present invention is directed to a method and device for recycling diesel engine coolant. Finally, the present invention is directed to a method and device for avoiding catastrophic failures of liners of diesel engines.

Nearly all diesel engines rely on liquid cooling systems to transfer heat out of the block and passages of the engine. The typical diesel engine has a cooling system that consists of a closed loop that contains major components such as a water pump, radiator or heat exchanger, water jacket and a thermostat. The water jacket includes coolant passages in the block, heads and the radiator.

Air pockets in the radiator and associated coolant passages can hamper and compromise engine performance and durability. This can be evidenced in a variety of locations but is particularly acute when associated with cylinder head liners employed in various diesel engines. Catastrophic failure of cylinder head liners can be associated with the presence of localized air pockets in the radiator or coolant fluid circulating system generally result in inadequate cooling and heat transfer.

Various engine maintenance procedures require the partial or complete draining of the coolant fluid system. It is posited that air pockets can be introduced during the refilling operations. These air pockets result in comprised cooling efficiency and can result in "hot spots" that can lead to the thermal degradation of sensitive diesel engine liners located in these cylinders.

Thus, it would be desirable to provide a method and device for systematically replenishing coolant fluid in a radiator fluid circulating system associated with a diesel engine. It would also be desirable to provide a system for reciprocally removing and replacing coolant fluid. Further, it would be desirable to provide a method for reducing or minimizing catastrophic failure of diesel engine liners by utilizing a coolant recycle and/or replenishment process that reduces or eliminates air pockets in the associated engine cooling system.

SUMMARY

Disclosed herein is a method for replacing a volume of coolant fluid in a heat exchange system of a diesel engine. The method includes the steps of establishing pneumatic connection between an externally located pressurizable recycling tank and at least one location in the diesel engine coolant circulating system and establishing fluid connection between the externally located pressurizable recycling tank and at least one location in the diesel engine coolant fluid circulating system that is different from the pneumatic connection point. After pneumatic connection and fluid connection have been established, drawing a vacuum pressure through the pneumatic connection and introducing a volume of coolant fluid through the fluid connection.

BRIEF DESCRIPTION OF THE DRAWINGS

In the present disclosure reference is made to the following various drawings in which like reference numerals are used for like elements throughout the various figures. The drawing figures are for illustrative purposes only and include the following:

FIG. 12 is a schematic diagram of a representative diesel engine; and

FIG. 13 is representative operating instructions utilizing an embodiment of the device disclosed herein to accomplish coolant drain operations; and FIG. 14 is representative operating instructions utilizing an embodiment of the device disclosed herein to accomplish coolant fill operations and pressure testing;

DETAILED DESCRIPTION

Figure 1:
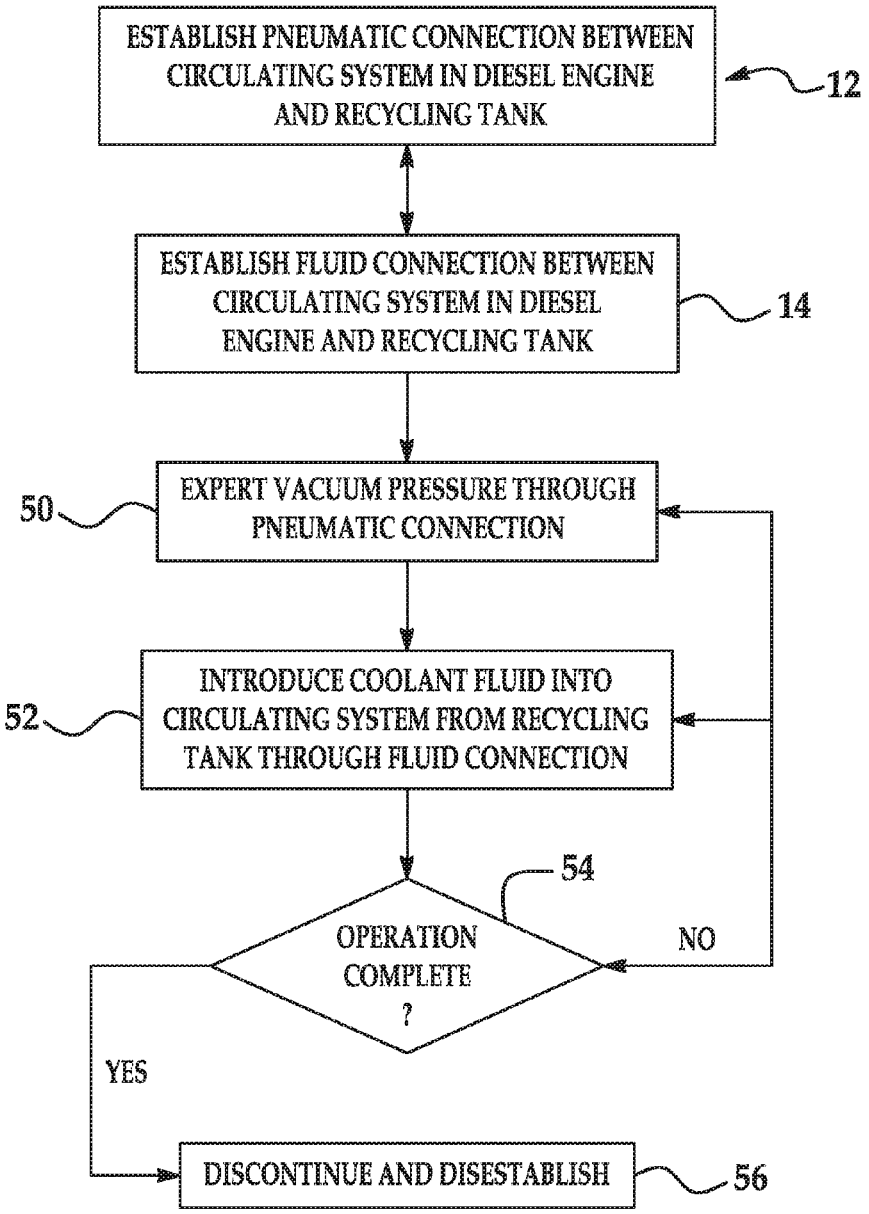
FIG. 1 is a process diagram of an embodiment of the method for replacing a volume of coolant fluid in a circulating system in a diesel engine as disclosed herein.

Broadly disclosed herein, the present disclosure contemplates a method through which a volume of coolant fluid can be introduced into the circulating system of a diesel engine utilizing vacuum to obtain positive fluid flow. Without being bound to any theory, it is believed that the use and application of the method as broadly disclosed herein can result in the minimization and/or elimination of air pockets in the coolant fluid as it circulates in the cooling system of the engine. This can protect the engine and reduce or eliminate thermal failure of sensitive engine liners such as those found in the cylinder heads. Where desired or required, the method includes pressurized delivery of coolant fluid into the circulating system as well as the removal of coolant fluid from the circulating system utilizing vacuum and/or pressure. An embodiment of the method of replacing a volume of coolant fluid is broadly disclosed and illustrated in FIG. 1.

As used herein, coolant fluid is generally defined as the aqueous or organic material introduced into the cooling system of an associated diesel engine to transfer waste heat out of the block and various internal components of the engine. Typically, the cooling system can include various pumps, radiator and/or heat exchangers as well as a coolant jacket and circulating conduit, together with suitable regulators such as thermostats and the like. Schematic depiction of a representative diesel engine cooling system is set forth in FIG. 12.

In the method disclosed herein, pneumatic connection is established between the circulating system in the diesel engine and a suitable remote recycling tank. This step is set forth in the process diagram of FIG. 1 at reference numeral 12. Pneumatic connection can be established at any suitable location. In certain embodiments it is contemplated that the pneumatic connection to the circulating system can be made in the radiator, or at a location on or proximate to the radiator pressure cap. The suitable remote recycling tank can be any suitable vessel in communication with the circulating system. It is contemplated that the method disclosed herein can be efficaciously employed utilizing an embodiment of the device which will be described in greater detail subsequently.

The method 10 also includes the step of establishing fluid connection between the circulating system and the associated diesel engine and the recycling tank. This step is outlined in the process diagram at reference numeral 14. Fluid connection between the circulating system and the recycling tank can be accomplished at any suitable location in the cooling system. In various non-limiting embodiments, it is contemplated that the fluid connection will be established at a position in the radiator. Where desired or required, the connection will be established at the lowermost region of the radiator, generally opposed to the pneumatic connection established in the pressure cap. This connection can be made at the radiator drain if desired or required.

The pneumatic and fluid connections can be established by any suitable means. The connections will be configured so as to be removably established for the duration of the coolant introduction (and/or removal) process. In various non-limiting embodiments it is contemplated that the pneumatic and fluid connections will be established by suitable quick connect mechanisms.

Once the pneumatic and fluid connections have been established as at reference numerals 12 and 14, suitable vacuum pressure can be exerted or drawn through the pneumatic connection as at reference numeral 50. The vacuum pressure exerted can be any vacuum pressure greater than zero and less than approximate 30 pounds vacuum per square inch. Vacuum pressure will be exerted through the connection and provided by suitable external vacuum generating mechanisms. In various non-limiting embodiments, it is contemplated that the vacuum pressure mechanism will be present in a device associated with the remote recycling tank. Non-limiting examples of such mechanisms are described in such detail subsequently.

The method also contemplates the introduction of coolant fluid into the circulating system from the recycling tank through the established fluid connection as at reference numeral 52. Coolant fluid introduction can be accomplished by any suitable mechanism. It is contemplated that the coolant fluid is introduced into the circulating system of the associated diesel engine under either positive or negative vacuum and/or pressure. The pressure can be provided by suitable pressure generating devices associated with the recycling tank. Various pressurization mechanisms will be described in greater detail subsequently. Similarly, vacuum can be generated by suitable mechanisms as by vacuum venturi and/or a power device.

The method disclosed herein contemplates the pressurized delivery of coolant fluid into the circulating system or into a defined chamber in the circulating system such as the radiator. The pressurized delivery can be accomplished with suitable vacuum assist where desired or required. Fluid is introduced under pressure and/or vacuum to the coolant circulating system. In this way, the coolant fluid can be introduced into the radiator or appropriate chambers in the circulating system in a manner that reduces fluid cavitation, turbulence and the like during the introduction process that can introduce air and air pockets into the circulating coolant fluid. As such, it is contemplated that the exerted vacuum and/or exerted pressure will be appropriately complimentary to facilitate this introduction.

The volume of coolant fluid that is introduced into the engine system will be that sufficient to maintain the coolant level at a suitable value for engine operation. Thus, this volume can be anywhere from a fraction of the total volume of the coolant circulating system to the total amount contained therein. The specific amount will be that necessary for the needs of the given system. In certain instances, it is contemplated that the amount to be introduced will be equal to that amount removed or lost during repair operations such as repair or replacement of various radiator system components and the like. However, it is also contemplated that, depending upon the engine repair operation employed, the radiator system can be drained and coolant replaced to greater amounts as needed.

The sequence of exertion of vacuum and introduction of coolant fluid can be that necessary to optimally introduce coolant fluid into the circulating system. Thus, the vacuum exertion and fluid introduction steps 50, 52 can occur simultaneously. In certain embodiments, it is contemplated that coolant introduction will occur sequentially after the exertion of vacuum pressure through the pneumatic connection. Still a third sequence contemplates intermittent or pulsed exertion and introduction in which the vacuum pressure may vary. Typically in this latter sequence pressure will be maintained even if it does vary.

Figure 2:
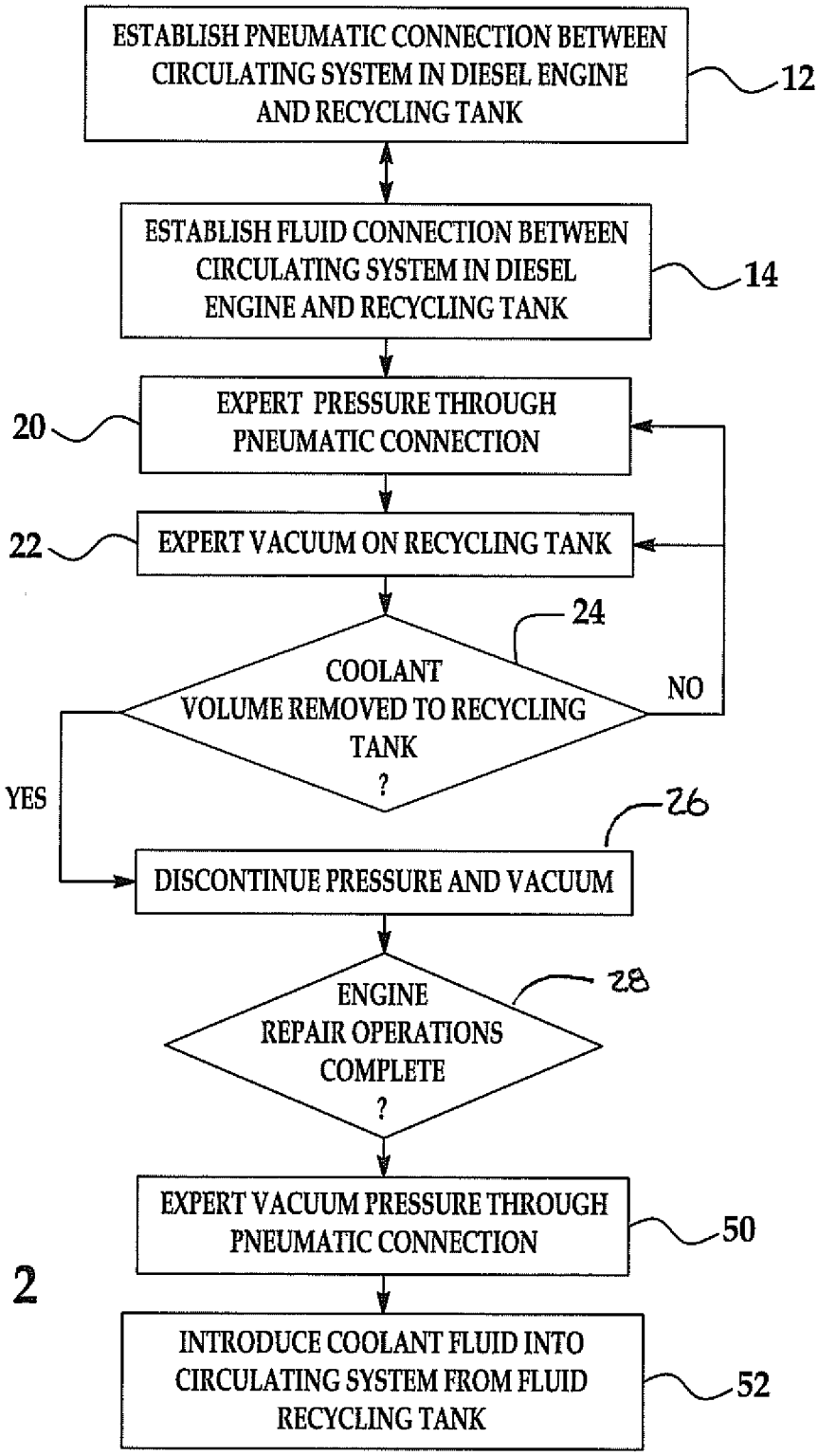
FIG. 2 is a detailed process diagram of an embodiment of the volume coolant fluid replacement method disclosed herein.

The defined fluid introduction process can continue until such time as the appropriate volume of coolant has been transferred as at reference numeral 54. This end point can be determined or defined by any suitable means. Non-limiting examples of such determination means include electronic sensor or visual determination by an appropriate user. Once the coolant fluid transfer operation is complete, the coolant fluid introduction steps with the discontinuation of vacuum pressure and/or positive pressure can be discontinued and the device connections disestablished as at reference numeral 56. If additional service or other procedures are required, they can continue as needed. Alternately, if engine service successfully completed, the engine can be brought back into service. Discontinuation of the vacuum pressure and fluid introduction can occur simultaneously or can be staggered sequentially.

Where desired or required, the method contemplated herein can also include suitable steps whereby the coolant fluid is removed from the associated circulating system of the diesel engine into the recycling tank. As broadly construed, an embodiment of the fluid removal process is depicted in FIG. 2. After pneumatic and fluid connections have been established as at reference numerals 12 and 14, suitable pressure can be exerted on the circulating system of the engine in general or on a specific chamber in the circulating system such as the radiator through the established pneumatic connection. This process step is depicted at reference numeral 20.

In order to facilitate removal of the desired volume of the coolant fluid, vacuum pressure can be drawn on the recycling tank as depicted at process step 22. This can occur contemporaneous to the pressurization step 20 in certain embodiments. It is contemplated that the pressure and vacuum exertion steps will continue contemporaneously for a sufficient interval to remove the desired volume of coolant to the associated recycling tank.

The volume of fluid removed can be equal to the total volume of fluid contained in the engine coolant system or any lesser fraction thereof. In situations where limited service is necessary such as replacement of a thermostat or sensor or the like, it may be possible that only partial coolant removal is desired or required. However, in certain service regimens, complete or near complete coolant removal may be desired or required. The volume of coolant to be removed can be determined and ascertained by any suitable means. In certain embodiments, the fluid removal volume may be measured and regulated by various sensors or other indicia. However, it is also within the purview of this invention that volume removal may be ascertained by the user by suitable visible inspection or the like. In the process depicted in FIG. 2, coolant volume is ascertained at reference numeral 24.

In the process depicted in FIG. 2, once the appropriate volume of fluid has been removed to the recycling tank, pressure and vacuum exertion is discontinued as at reference numeral 26. Engine repair and service operations can proceed until completed as at reference numeral 28. After appropriate service and repair operations are complete, vacuum pressure can be exerted through the pneumatic connection as at reference numeral 50 and coolant reintroduced into the circulating system from the recycling tank as at reference numeral 52.

While certain embodiments contemplate the contemporaneous exertion of pressure and vacuum as outlined in reference numerals 20 and 22, discontinuation of these two activities can be either simultaneous or staggered, depending upon the specific system requirements. In certain embodiments, it is contemplated that vacuum pressure exerted on the recycling tank will be discontinued prior to the discontinuance of pressure through the pneumatic connection in order to maintain the various collapsible hoses associated with the engine and/or recycling tank in an open position. Similarly, it is contemplated that discontinuance of vacuum and pressure operations can be staggered during the refill phase. In certain embodiments, it is contemplated that the pressure operation during refill will be discontinued prior to discontinuance of vacuum pressure in order to facilitate and further remove any air pockets that may have developed in the circulating system during the refill process.

Figure 3A:
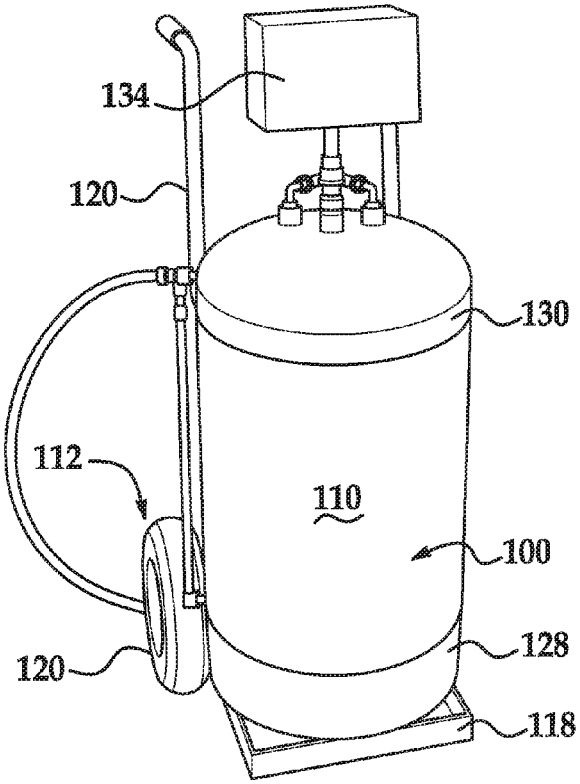
FIGS. 3A and 3B are front views of a coolant fluid replacement device according to an embodiment as disclosed herein.
Figure 3B:
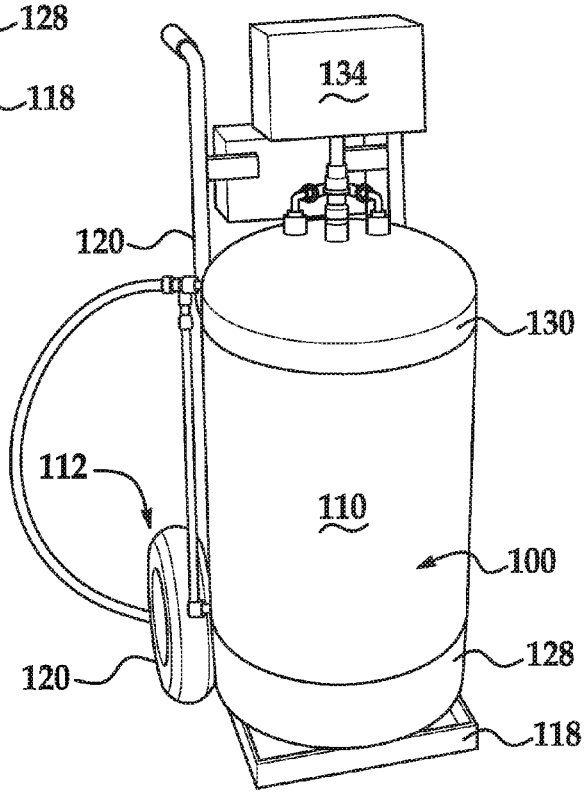
Figure 4A:
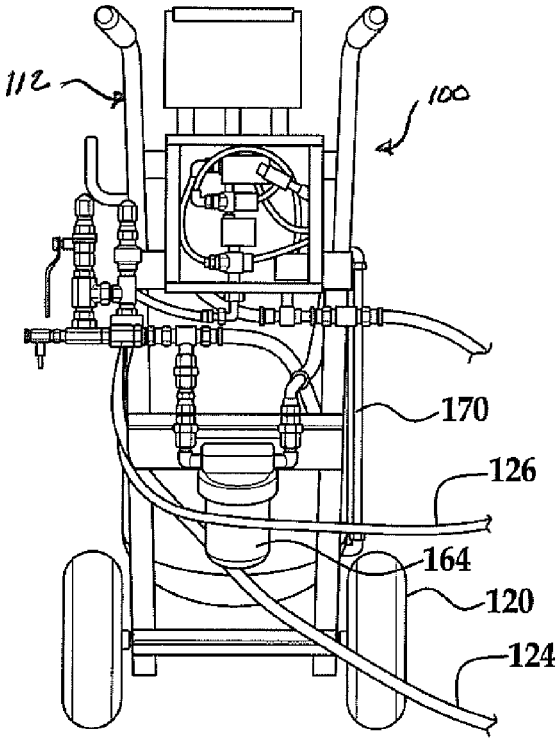
FIGS. 4A and 4B are rear views of the device of FIG. 3.
Figure 4B:
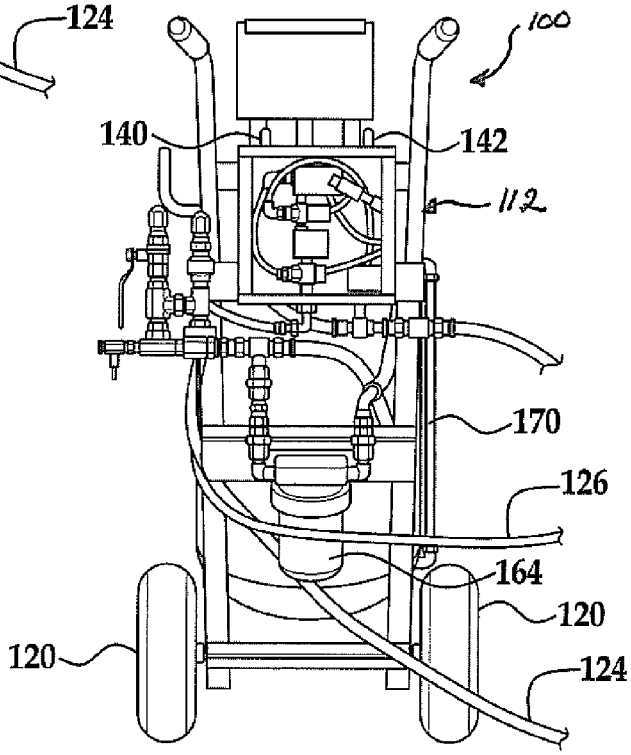
Figure 5:
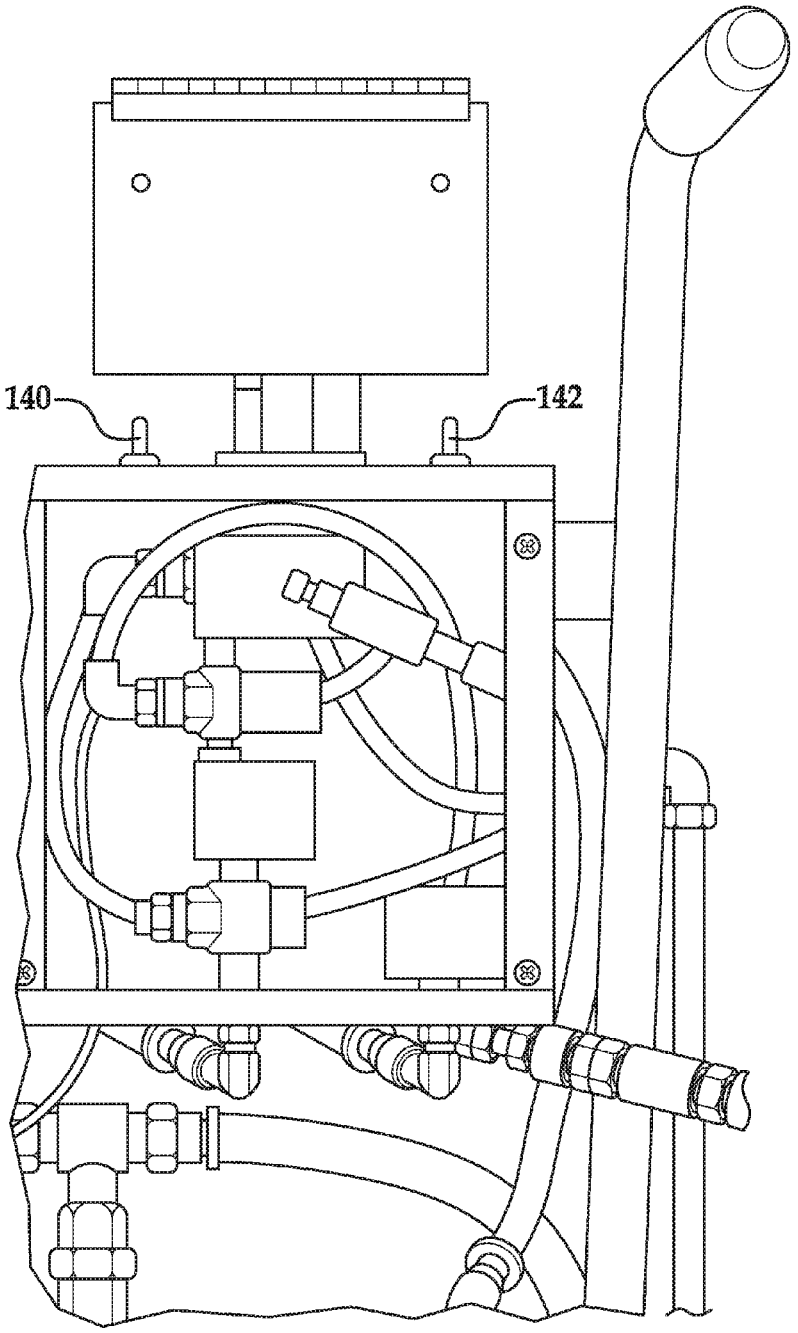
FIG. 5 is a detailed view of pneumatic controllers, pressure generators and vacuum generators of the device as depicted in FIG. 3.

The process disclosed herein can be accomplished utilizing a suitably configured removable disconnectable externally positioned device. A non-limiting embodiment of such a device is depicted at reference numeral 100 in FIGS. 3, 4, and 5. The device 100 as depicted in the various drawing figures includes a suitable pressurizable recycling tank 110 that is connected to an appropriate vacuum generating device and pressure generating device. The recycling tank 110 can be stationary if required. However, in the embodiment depicted in the drawing figures, recycling tank 110 together with suitable optional vacuum generating mechanism(s) and pressure generating mechanism(s) is transportably mounted to a suitable device such as a frame 112. The transportable frame 112 can be either mechanized or not as desired or required. In the embodiment depicted, the transportable frame 112 includes a suitable base 118, wheels 120 and side frame members 120 with handles and the like.

The device 100 can include suitable means for detachably connecting the recycling tank 110 to the coolant recirculating system of an associated diesel engine. In the embodiment depicted, the connection means include at least one fluid hose 124 and at least one pneumatic hose 126. The fluid hose 124 and pneumatic hose 126 are coupled to the recycling tank 110 at any suitable location. In the embodiment depicted, the fluid hose 124 is coupled to the recycling tank 110 at a location proximate to the lower end 128 of recycling tank 110 when the device 100 is in the operative or use position. The pneumatic hose 126 connection is located in the general upper region 130 of recycling tank 110.

Fluid hose 124 and pneumatic hose 126 each respectfully have ends distal to their connection points with the recycling tank 110. Distal ends of hoses 124 and 126 are each configured to releaseably connect to specified location in the associated coolant circulating system of the engine. Where desired or required, the connection configuration can include suitably configured quick connect mechanisms. The device 100 can include suitable closure or isolating mechanisms such as shut off valve 132 configured to isolate the recycling tank 110 when the device 110 is not in operation.

Recycling tank 110 will have a sufficient interior volume to receive the transferred coolant fluid. Recycling tank 110 can be configured with suitable devices to insure that air is not introduced into the circulating system. This can include suitable floats or shut off valves positioned in the tank to prevent over-evacuation of the recycling tank during engine fill operations or overfilling during removal operations.

Where desired or required, the recycling tank 110 can be configured to maintain a residual amount of coolant fluid in the tank to prevent or avoid accidental introduction of air into the coolant circulating system. The device 100 can also include a suitable fill mechanism in order to insure a proper amount of residual fluid is present in the recycling tank 110 to further insure against accidental introduction of air. One non-limiting example of a suitable fill device is fill tank 134 in fluid contact with recycling tank 110.

The device 100 can also include a suitable control mechanism that can regulate and direct the orientation of vacuum and pressure introduction. The device can include suitable user-operated switches or can be automated as desired or required. In the embodiment depicted in FIGS. 3, 4, and 5, it is contemplated that the device will be user operated by suitable manual switches such as switches 140 and 142.

Figure 10:
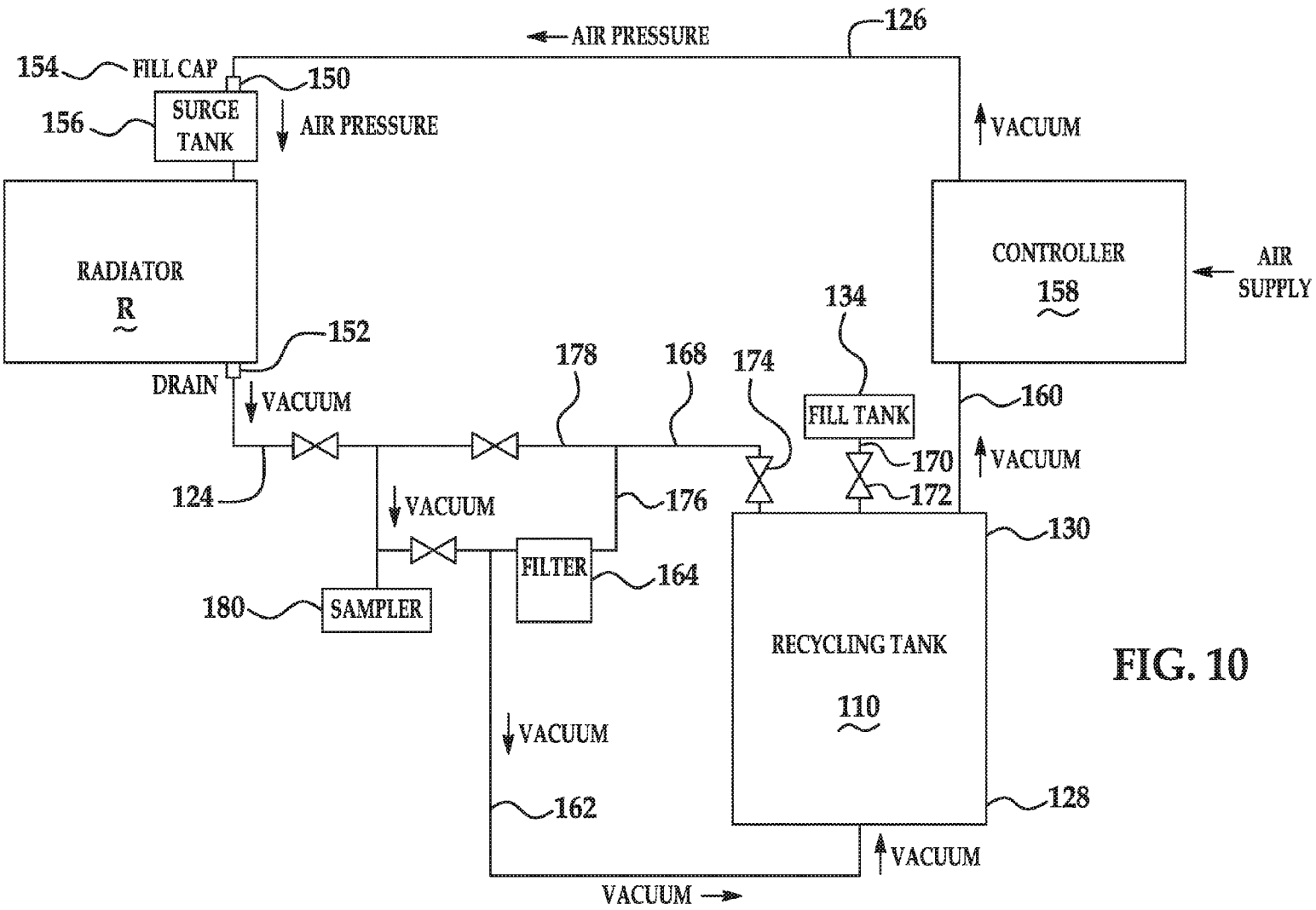
FIG. 10 is a schematic diagram of an embodiment of the device as disclosed herein as coupled to a diesel engine radiator in which the system is operating in an evacuation mode.
Figure 11:
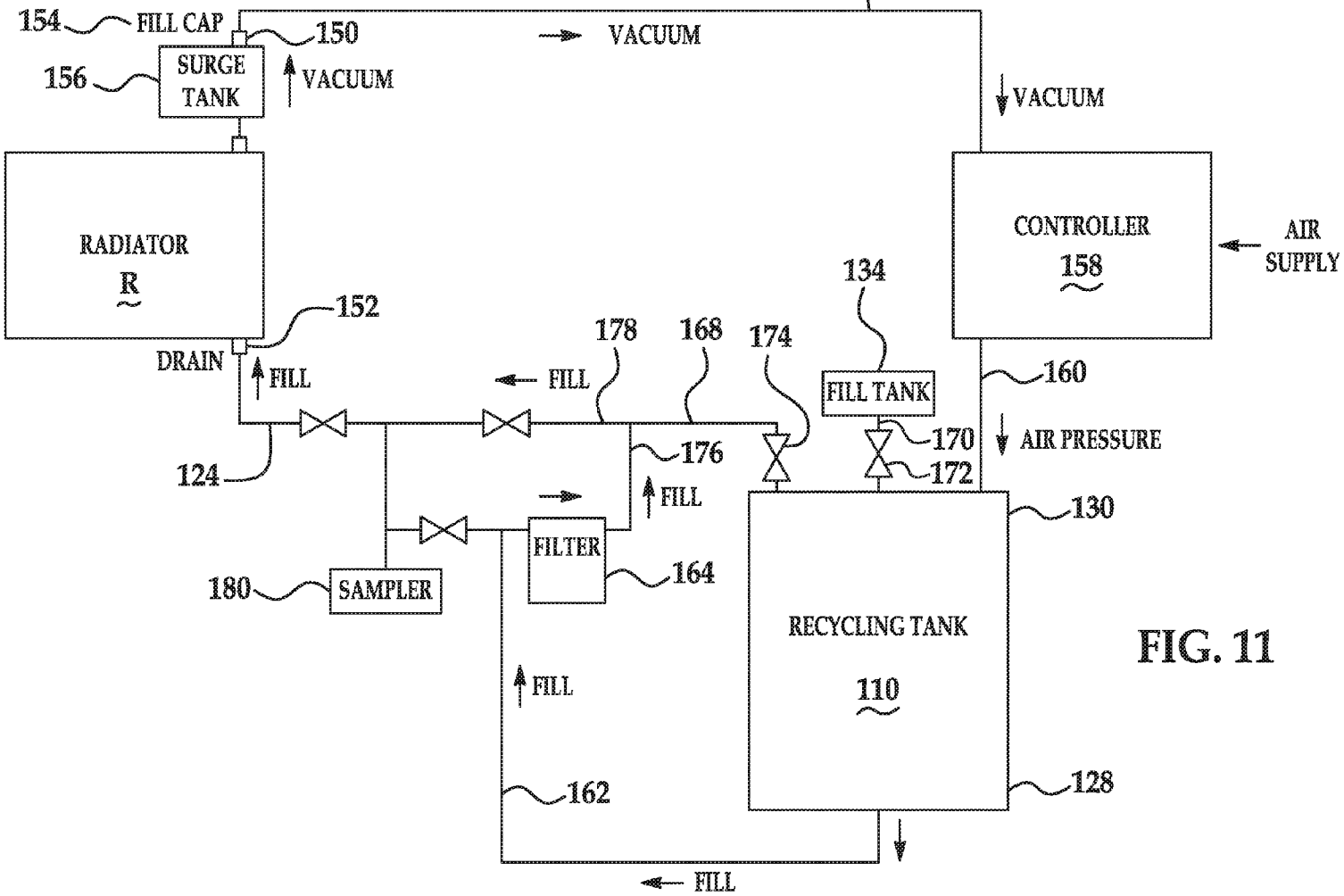
FIG. 11 is a schematic depiction of an embodiment of the device as disclosed herein in which the system is operating in fill mode.

In order to further describe the device and process disclosed herein, reference is made to the schematic diagrams depicted in FIGS. 10 and 11. Device 100 is coupled to the radiator R of the coolant circulating system of an appropriate diesel engine. The releasable coupling is accomplished using suitable coupling mechanisms 150 and 152 located at the fill cap and drain respectfully. The mechanisms 150 and 152 can be configured as suitable mating quick connect mechanisms in which a first member is associated with the respective fluid line or pneumatic line and a second matting member is integrally attached to the engine cooling system at appropriate locations. Once communication has been established, filling or suitable coolant evacuation can be begun. In evacuation mode as depicted in FIG. 10, pressured air is introduced through the air line 126 via fill cap 154 into radiator R. Where desired or required, this pressured air introduction can occur through surge tank 156. The direction of air pressure introduction is depicted by suitable arrows throughout the diagram in FIG. 10.

Pressurized air can be provided by any suitable means. The device 100 can include suitable compressors if desired or required. However, in the embodiment depicted in FIGS. 3, 4, and 5, the device 100 will include suitable coupling mechanisms to establish communication with a suitable pressurized air supply such as a shop air or the like. The device 100 can also include suitable controllers and regulators, depicted generally at reference numeral 158 in order to regulate the introduced air supply and control or step down pressure from the level delivered by the external pressurized air source to a pressure level appropriate for operation of and use by the device 110. It is contemplated that the maximum pressure of air introduced into the radiator through line 126 during evacuation mode will be one that is at or below appropriate tolerances for the associated engine. In certain applications this will dictate a pressure level at or below 15 pounds psi. It is understood that other pressure levels may be utilized provided that the pressure introduced does not adversely affect the engine cooling system. Thus the device 110 can include various pressure regulators and step down devices as required.

Either simultaneously with the introduction of pressured air or sequential thereto, a suitable vacuum is drawn on the fluid contained in the circulating cooling system through fluid hose 124 connected to a suitable drain opening associated with connection 152. The vacuum pressure is exerted on recycling tank 110 through suitable intermediate pneumatic line or lines 160 in communication between recycling tank 110 and suitable vacuum generating means. The vacuum generating means can be any suitable device or devices capable of producing vacuum in recycling tank 110. Non-limiting examples of such devices include various vacuum pumps and the like. In the embodiment depicted in FIG. 10, the vacuum generating device can be housed in controller 150 and can include a suitable pneumatic means such as a venturi(s) (or the like) triggered by the introduction of pressurized air from the exterior air supply source.

The vacuum that is exerted on recycling tank 110 results in a vacuum or negative pressure in intermediate supply line 162. This results in drawing coolant fluid from the radiator through fluid line 124 into intermediate line 162 and, ultimately, into recycling tank 110. Lines 124 and 162 can have suitable check valves to direct coolant fluid flow in the desired direction.

In the schematic embodiment depicted in FIG. 10, the device 100 includes a suitable on board filter 164. The filter 164 is positioned in communication with fluid lines 124 and intermediate line 162. It is contemplated that in certain embodiments that during vacuum evacuation processes, a small amounts or percentages of the evacuated fluid to pass through filter 164 and line 168 entering the recycling tank in the upper region 118. However, it is contemplated, that the larger volume of evacuated coolant fluid will traverse line 124 into line 162 and enter recycling tank 110 in the bottom region 116. It is also within the purview of this disclosure to provide filtration devices that will contact all or most of the coolant fluid prior to entry into the recycling tank 110.

The device 100 can include suitable volumetric measuring mechanisms to ascertain the volume of fluid contained in recycling tank 110. One non-limiting example of such a volume ascertainment mechanism is sight glass 170 which can be seen in FIGS. 3 and 4.

Completion of fluid evacuation can be determined by any number of indicia. The user can refer site glass 170. If desired, controller 158 can be configured with suitable pressure and vacuum gauges (not shown). It is contemplated that during the evacuation process, pressure and vacuum will remain steady until the process nears completion at which time a pressure and vacuum level drop will be noted. These phenomena can be utilized to trigger or signal the end of evacuation mode. It is contemplated that these indicia can be employed to initiate an automatic shut-off of the system. However, in various embodiments, such is that depicted in FIGS. 3, 4, and 5, the shut-off can be user-initiated as by a suitable shut off switch 140.

Once coolant fluid evacuation is completed, the radiator or other portions of the cooling system can be serviced as desired or required. Once service operations are completed, coolant fluid can be reintroduced into the radiator and associate coolant circulating system. One non-limiting reintroduction configuration is depicted in the schematic in FIG. 11. In order to operate device 100 in fill mode, controller 150 reconfigures suitable valves and mechanisms located therein in order to exert pressure in line 160 and vacuum in air line 126. In the fill mode configuration, the pressure exerted on line 160 need not be constrained nor limited by radiator operation parameters. Thus, in fill mode, the maximum air pressure introduced into line 160 can be higher than the 15 psi pressure maximum indicated previously.

Air pressure introduced through line 160 into recycling tank 110 creates a pressure head on coolant fluid contained therein. In order to maintain pressure, any lines such as line 170 located between fill tank 134 and recycling tank 110 can be equipped with suitable check valves such as check valve 172 to insure that the pressurization of tank 110 is maintained during the filling operation. Similarly, intermediate line 168 can also be configured with a suitable pressure check valve such as 172. During fill mode operations, pressurized coolant fluid exits recycling tank 110 at lower location 128 through intermediate line 162. The coolant fluid is directed through filter 164 and into bypass line 176. Bypass line 176 is connected to line 178 which itself is connected to fluid line 124. Coolant fluid passing through line 124 is introduced into the radiator at the connection mechanism 152 located proximate to the lower region of the associated radiator R.

During pressurized fluid introduction, vacuum is drawn on line 126 connected at connection 150 proximate to fill cap 154 and surge tank 156. During fill operations, the radiator experiences a negative pressure which urges coolant fluid into the radiator and any associated regions in an orderly non-turbulent fashion. It is contemplated that the vacuum pressure exerted on line 126 can be any pressure that is greater than 0 and is up to a pressure a vacuum level of 27 psi. In certain embodiments, it is contemplated that the vacuum level of greater than 27 can be employed.

It can be appreciated that the pressure differential between pressurized fluid introduced into the radiator and the vacuum into which it is introduced can have a value between 10 and 60 psi. Without being bound to any theory, it is believed that the negative pressure experienced by the radiator during the fill operations removes or reduces the air pockets formed as a result of any cavitation or turbulent fluid flow which occurs during fluid introduction into the radiator. Furthermore, without being bound to any theory, it is believed that the pressure differential, in certain instances is sufficient to impact and dampen turbulent fluid flow experienced upon fluid introduction.

The phenomenon of pressure differential also exists in the evacuation mode cycle. During evacuation, fluid is drawn from the radiator under vacuum with the associated introduction of pressurized air at the fluid or pressure head. Thus, the radiator experiences a pressure differential that exceeds the maximum value of pressurized air introduced. The pressure differential achieved by operation of pressurized air introduction and vacuum permits and facilitates the removal of coolant fluid. In effect, the fluid is removed under a pressure differential that is effective for removal and is greater than the upper threshold for pressurized air introduction.

The fluid that is introduced during the fill operations can pass through filter 164. Filter 164 is configured to trap or eliminate any particulate material as well as any other contaminates to insure that the material is not introduced into the radiator during filling operations. Where desired or required, this system can also be configured such that filter 164 can be placed in the fluid path to filter material during the evacuation mode cycle.

In order to bring the device 100 into engaged fluid contact with the associated vehicular circulation system, the vehicle can be configured with suitable engagement mechanisms. Non-limiting examples of such engagement mechanisms can include quick connect mechanisms.

Figure 6A:
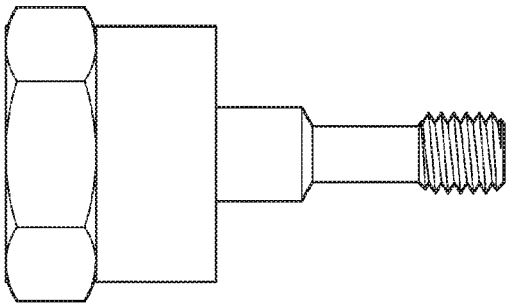
FIG. 6A is a side view of a quick connect nipple for use in various embodiments of the device disclosed herein.
Figure 6B:
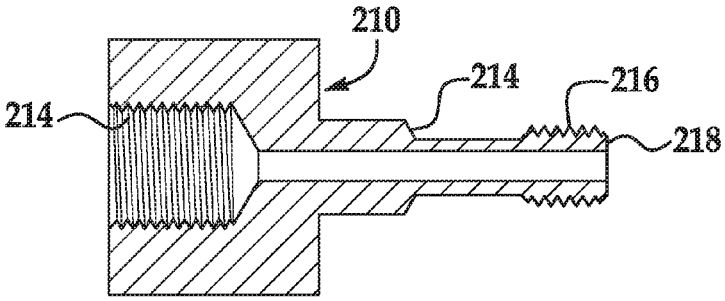
FIG. 6B is a cross-sectional view through FIG. 6A.
Figure 7:
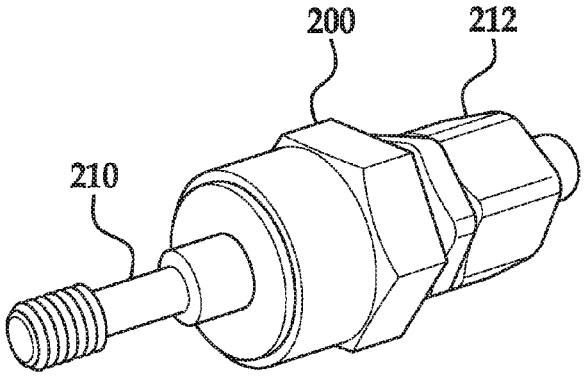
FIG. 7 is a perspective view of the quick connect nipple of FIG. 6A.
Figure 8:
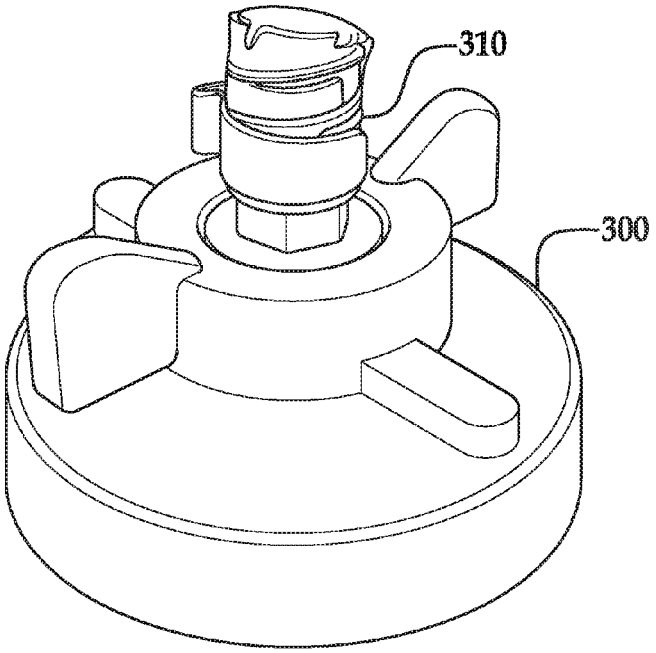
FIG. 8 is a detail of a quick connect nipple associated with a radiator cap.
Figure 9:
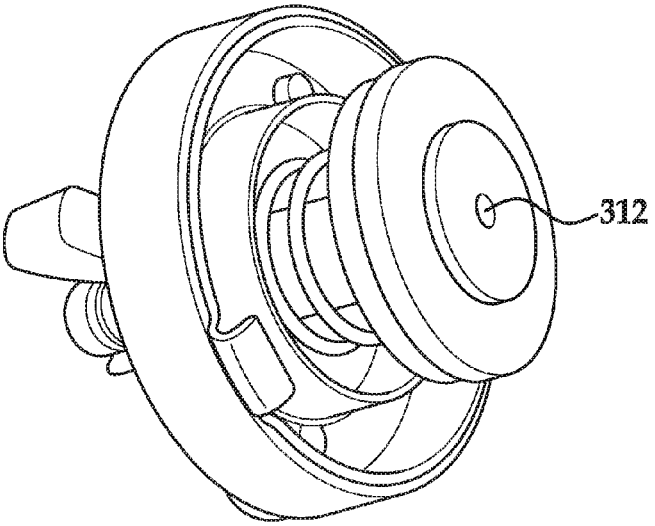
FIG. 9 is a bottom perspective view of the radiator cap of FIG. 8.

In certain embodiments, the radiator drain opening can be configured with one part of a suitable quick connect member. Where desired or required, the device 100 can include a suitable connector or coupler member 200 that can be configured to include or accommodate a mating member of a quick connect coupling member. One embodiment is illustrated in FIGS. 6A, 6B and 7. Coupler member 200 includes nipple member 210 connected to filtering 212 by any suitable connection device.

In the embodiment depicted, the coupler member 200 includes a nipple member 210 that is connected to a suitable fitting 212 by any suitable manner. In the embodiment depicted in the drawing figures, the fitting 212 can be configured with an externally threaded male protrusion configured to engage with internally threaded region 214 configured in the central interior of body 210.

Nipple member 210 can include appropriate step projections to maintain pressure contact between hose member 124 and the exit. Such step indentations 214 include shoulders as depicted in the drawing figures but are not considered limitative thereto. Where desired or required, the nipple 210 can include a threaded region 210 located on the end 218 distal to filtering 212.

The upper radiator fitting can be located at any appropriate position relative to the radiator. In various non-limiting embodiments, it is contemplated that the radiator cap 300 can be configured with a suitable quick connect pressure fitting member 310 adapted to receive a suitable mating quick connect member (not shown). The quick connect member 310 can communicate with a suitable pressure bore 312 to permit the delivery of pressurized air or, alternately, the exertion of vacuum.

In the embodiment depicted the radiator cap 300 can include a suitable outer cap body 314 configured to engage the outer surface of a corresponding radiator opening. In the embodiment depicted, this can include suitable inwardly projecting flanges 316 that can engage suitable external threads or other engagement devices present on the radiator opening.

The radiator cap 300 can be configures with one or more pressure seals 316, 318 in order to maintain pressure tight relationship during routine engine operation as well as during fluid evacuation and replacement operations.

The quick connect member 310 associated with the radiator cap 300 can project outward from the top surface 320 of the cup body 314 and can include a suitable coupler 322 configured to matingly engage a suitable hose member on device 100 as a pressure fitting. In the embodiment depicted, the quick connect member can include suitable spring loading mechanisms to provide access to the upper portion of the through bore 312 and trigger opening of the same.

Various points of the disclosure are:

1. The volume of coolant is introduced under pressure.

2. The method of which the volume of coolant fluid is introduced is sufficient to fill the engine circulating system.

3. The method in which the volume of coolant fluid introduced is maintained in a pressurizable recycling tank.

4. The method of point 3 in which the coolant fluid is removed to the recycling tank, a method comprising the steps of:

exerting gas pressure on fluid contained in the engine circulating system wherein pressurization occurs through the established pneumatic connection;

drawing a vacuum on the recycling tank and associated fluid connection, the vacuum level sufficient to draw coolant fluid from the circulating system into the recycling tank.

5. The method of point 4 wherein the pressurized gas employed during coolant removal is at a value between 0 and 15 psi.

6. The method of point 5 wherein the vacuum employed during the coolant removal step is between 15 and 27 psi.

7. The method of point 1 wherein at least one of said pneumatic connection establishing step or said fluid connection establishing step utilize at least one quick connect adapter device having a first member associated with the recycling tank and second member associated with the diesel engine circulating system.

8. The method of point 7 wherein the recycling tank is maintained on a remote device in combination with a suitable pressurization device and a suitable vacuum generating device.

9. The method of point 1 wherein pneumatic communication with the volume of coolant is established at a location proximate to a fill cup on a radiator and wherein fluid communication is established at a drain on the radiator.

10. The method of point 1 wherein pneumatic communication and fluid communication are established by connecting the connecting circulatory system with a device comprising a pressurizable coolant fluid recycling tank, at least one air pressure regulator and connector releasably engageable with a pressurized air source. At least one vacuum generator and at least one pressure regulator and means for alternating between pressure and vacuum.

11. A device for reciprocatingly removing and replenishing coolant fluid in the cooling system of a diesel engine comprising:

a pressurizable coolant fluid recycling tank;

at least one air pressure regulator and connector releasibly engageable with a pressurized air source;

at least one vacuum generator;

at least one pressure regulator;

means for switching between vacuum and pressure.

Also disclosed herein is a float device 400 that can be utilized in combination with the pressure valve or other suitable container to stop fluid flow exiting from a container such as container or reservoir 128 once the level reaches a predetermined (low) level. The float device 400 has a shaft body such as elongated shaft body housing 410. The elongated shaft body 410 has an exterior surface such as exterior surface 432 and can have any suitable configuration such as the hexagonal external body surface as illustrated. The elongated shaft body 410 also has a through shaft 434 which in the illustrated embodiment is a generally cylindrical shaft. The shaft body housing 410 also has a first end 436 and an opposed second end 438.

The shaft body housing 410 has at least one bore 414 defined in the shaft body housing 410 in an orientation which is generally perpendicularly oriented to the through shaft 434 and extends from the through shaft 434 and the exterior surface 432. In the embodiment depicted in the various drawing figures, the shaft body housing 410 has a plurality of bores 414 circumferentially positioned around the shaft body 410 at a location between the first end 436 and second end 438. The bore(s) 414 are located generally proximate to the first end 436 of the shaft body housing 410. The bore(s) 414 are configured to facilitate fluid flow there through as desired or required. When the float device 400 in the mounted use position, fluid can flow through the bores 414 and through an associated opening defined in the bottom of the float housing 410 such as opening 440.

Figure 15A:
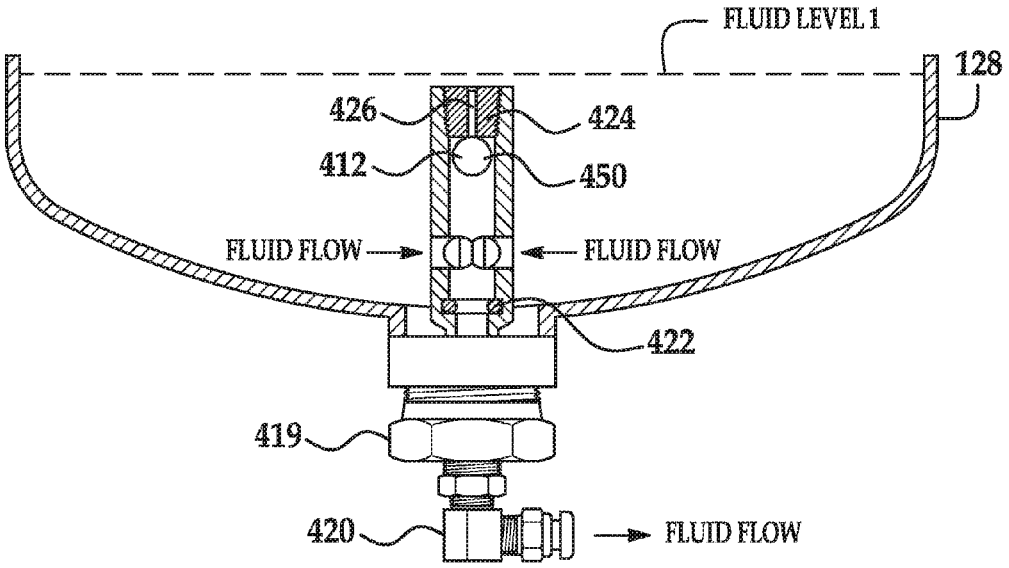
FIGS. 15A, 15B and 15C are partial cross-sectional views of an embodiment of the pressure tank of a device as disclosed herein with an embodiment of a universal positive float valve as disclosed herein in operative presence therein showing the sequence of fluid removal.
Figure 15B:
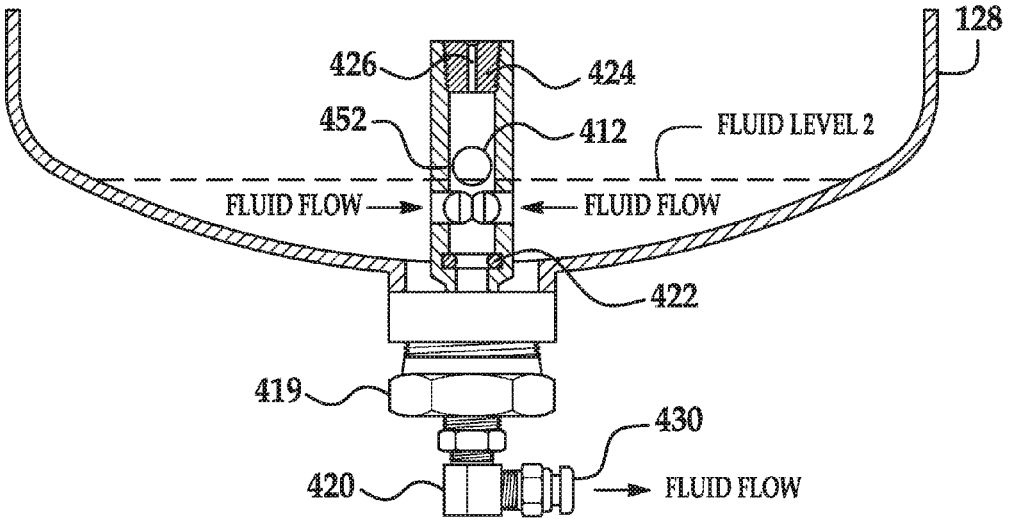
Figure 15C:
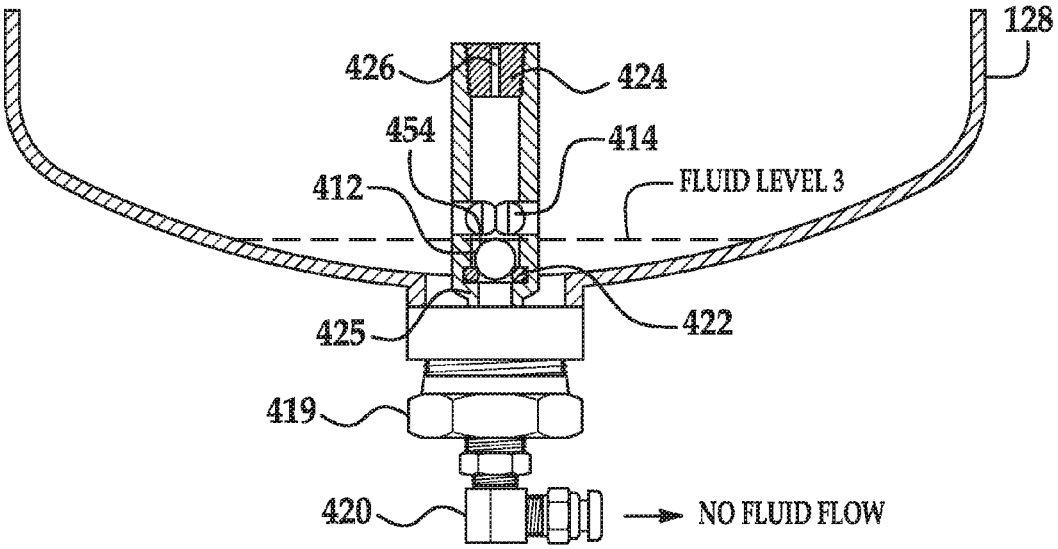
Figure 16:
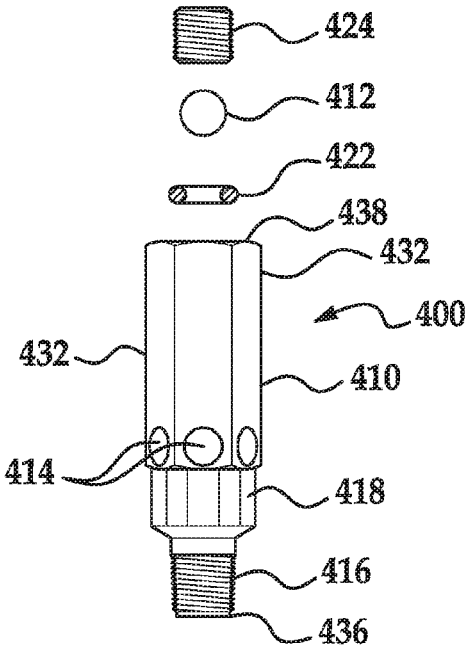
FIG. 16 is an exploded view of an embodiment of the universal positive float valve as disclosed herein.
Figure 17:
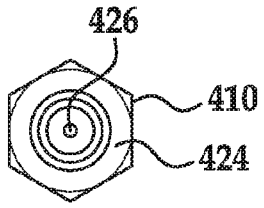
FIG. 17 is a top view of the float valve of FIG. 16 depicting an embodiment of a plug member as disclosed herein.
Figure 18:
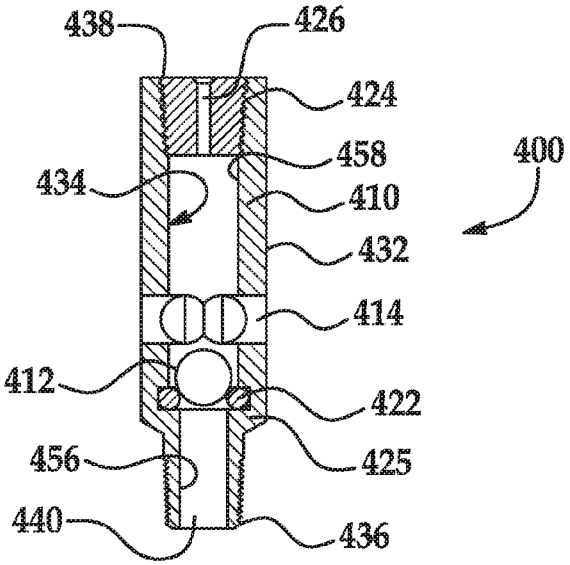
FIG. 18 is a cross-sectional view of the float valve of FIG. 16.
Figure 19:
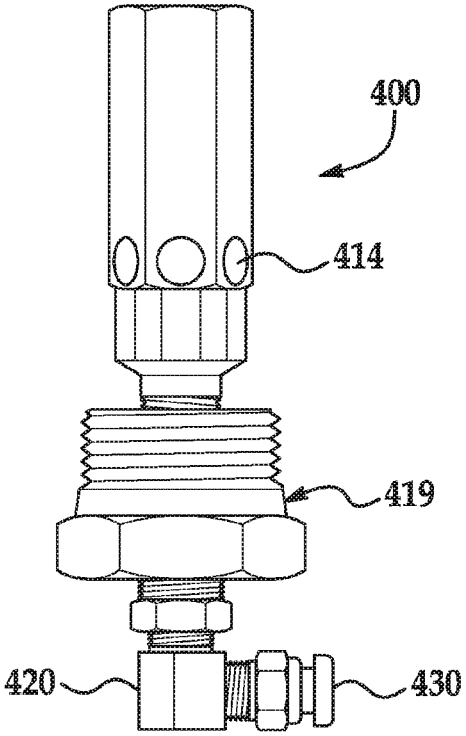
FIG. 19 is a side view of a float valve assembly with the float valve of FIG. 16.
Figure 20:
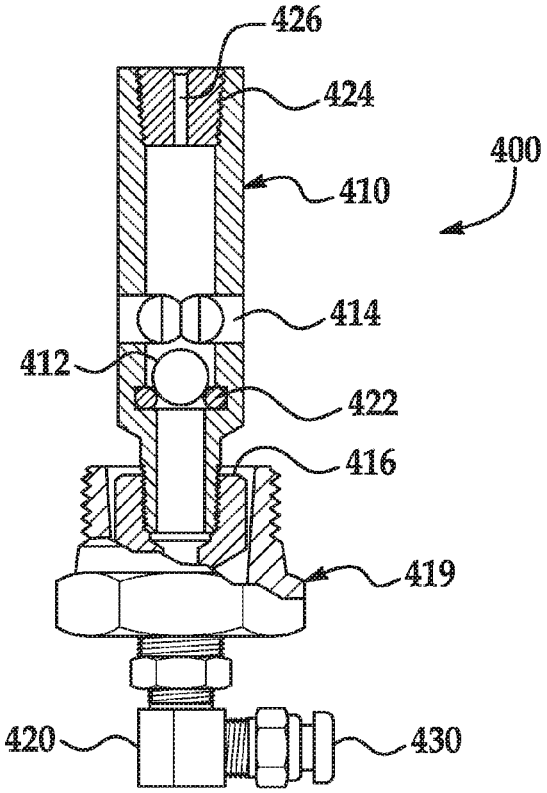
FIG. 20 is a cross-sectional view of the float valve assembly of FIG. 19.

The float device 400 also includes a float member 412 that is moveably positioned in the through shaft 434 in the shaft body housing 410. In the embodiment depicted in the drawing figures, the float member 412 can be a spherical body of a weight and density that will permit it to float on the surface of fluid as it is introduced or removed from an associated reservoir such as container or reservoir 128. The float member 412 is configured to move freely up and down the through bore between a first location 450 as illustrated in FIG. 15A and second location 452 as illustrated in FIG. 15B. The float member 412 can also move to a third location 454 as depicted in FIG. 15C. The float member 412 can have any suitable configuration and/or material. The float member 412 will have a size and dimension greater than the dimensions of the bore(s) 414. In the embodiment depicted in the various drawing figures, the float member 412 is spherical and can be composed of a suitable rubber or metallic material. The float member 412 can be hollow if needed or desired.

The float device 400 also includes means for sealing the top or second end 438 of the shaft body housing 410. It is contemplated that the shaft body housing 410 can have a seal integral to the shaft body housing 410 in certain embodiments. In the embodiment depicted in the various drawing figures, the float device 400 also includes a plug 424 having an opening 426 or other suitable venting means.

The float device 400 also includes a seal seat member 422 such as O-ring seal. The seal seat member 422 is configured to contact an internal shoulder 423 defined in the interior through bore in the shaft body housing 410. The seated seal member 422 can be located at a position generally proximate to the first end 436 of the shaft body housing 410. In the embodiment depicted in the drawing figures, the through bore 434 has a first region 456 having a first diameter proximate to the first end 436 of the shaft body housing 410 and a second region 458 proximate to the second end 438 having a second diameter. In the embodiment depicted in the various drawing figures, the diameter of the first region 456 is less than that of the second diameter with two regions contiguously connected to each other at a location defining a shoulder 425 of sufficient size and dimension to seat the seal seat member 422.

In the embodiment depicted in the drawing figures, the bore(s) 414 are located in the shaft body housing 410 relative to the shoulder 425 such that, when the float member 412 is seated on the seal seat member 422, the float member 412 is contained at a lower location bounded by the seal seat 422 on the lower portion and the bore(s) 414 at the upper region.

The shaft body housing 414 can also include suitable means for engaging an associated member such as a cap member 419. In the shaft body housing 410 can have an engagement region such as threaded region 416 configured to engage a matingly threaded region defined in an associated element such as a cap 419. The associated cap 419 can be configured to engage a suitable opening in a corresponding reservoir such as reservoir 128. Cap 419 can be configured as desired or required. In the embodiment depicted in the drawing figures, the cap 419 includes a suitable joint 420 in fluid communication with a member of quick connect member 422.

When the fluid level is above the float member 412 (Fluid level 1 as depicted in FIG. 15A), the ball float member 412 is prevented from leaving the shaft body hosing 410 by the vented plug 424. Fluid can leave the container 128 through holes or bores 414 in the shaft body housing 410 and on through the bottom of the device 400. When the fluid level drops (Fluid level 2 as depicted in FIG. 15B), the ball float 412 drops with the fluid level. As the fluid continues to drop, the float member 412 passes the bore(s) 414, slowing the rate of fluid flow out of the reservoir 128. When the fluid level falls below the bores 414 (Fluid level 3 as depicted in FIG. 15C), the ball float member 412 will seat against the seat seal 422 such as O-ring seal and prevent further fluid flow.

This device may be used to prevent unwanted air from entering a fluid conduit. It may be used as a control by sending a signal (pressure or vacuum) to a switch. It may be used as a volumetric measuring device.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for replacing a volume of coolant fluid in a circulating system in a diesel engine system comprising the steps of:

establishing pneumatic connection between an externally located pressurizable recycling tank and at least one location in the diesel engine coolant fluid circulating system;

establishing fluid connection between the externally located pressurizable recycling tank and at least one point in the diesel engine coolant fluid circulating system, the fluid connection location being different from the pneumatic connection, wherein the volume of coolant fluid is resident in the externally located pressurizable recycling tank;

after pneumatic and fluid connection is established, drawing a vacuum pressure through said pneumatic connection and introducing the volume of coolant fluid through said fluid connection, wherein the volume of fluid is introduced from the externally located reservoir through a float valve located in the externally located reservoir, wherein the float valve comprises:

a shaft body having an exterior surface, a first end and an opposed second end, the shaft body defining a single through shaft extending from the first end to the second end defining an interior area, the shaft body having at least one bore defined therein, the bore extending from the exterior surface to the single through shaft;

a float member configured to traverse the interior area of the single through shaft, the float member having a height (H);

at least one seated seal positioned at a fixed location in the single through shaft proximate to the first end of the shaft member, the seated seal configured to releasable contact the float member; and at least one stop member located proximate the second end of the shaft in contact with the shaft.

2. The method of claim 1 wherein the single through shaft of the float valve is composed of at least two regions, wherein a first region has a first diameter and the second region has a second diameter, wherein the first diameter is less than the second diameter and the first and second regions are contiguously connected to one another by means of at least one shoulder member, the seated seal positioned on the shoulder member.

3. The method of claim 1 for replacing a volume of coolant fluid in a circulating system in diesel engine system further comprising the step of:

providing a device for replacing a volume of coolant fluid in a circulating system in diesel engine system, in addition to the float valve, the device including:

a pressurizable coolant fluid recycling tank;

at least one air pressure regulator and connector releasably engageable with a pressurized air source;

at least one vacuum generator;

at least one pressure generator; and means for switching between vacuum and pressure.

4. The method of claim 1 wherein the volume of coolant fluid is introduced under pressure from the externally located pressurizable recycling tank.

5. The method of claim 1 wherein the volume of coolant fluid contained in the externally located pressurizable recycling tank and introduced into the diesel engine is sufficient to fill the engine circulating system.

6. The method of claim 1 wherein the coolant fluid is removed to the externally located pressurizable recycling tank a method comprising the steps of:

exerting a positive gas pressure on coolant fluid contained in the engine coolant circulating system wherein pressurization occurs through the established pneumatic connection;

drawing a vacuum on the recycling tank and associated fluid connection, the vacuum level sufficient to draw coolant fluid from the circulating system into the recycling tank.

7. The method of claim 6 wherein the pressurized gas employed during coolant removal is at a value between 0 and 15 psi.

8. The method of claim 6 wherein the vacuum employed during the coolant removal step is between 15 and 27 psi.

9. The method of claim 1 wherein at least one of said pneumatic connection establishing step or said fluid connection establishing step utilize at least one quick connect adapter device having a first member associated with the recycling tank and second member associated with the diesel engine circulating system.

10. The method of claim 9 wherein the recycling tank is maintained on a remote device in combination with a suitable pressurization device and a suitable vacuum generating device.

* * * * *